US006729983B1

(12) United States Patent
Vakili et al.

(10) Patent No.: US 6,729,983 B1
(45) Date of Patent: May 4, 2004

(54) TUBULAR SPORTS IMPLEMENT WITH INTERNAL STRUCTURAL BRIDGE

(75) Inventors: Ahmad D. Vakili, Tullahoma, TN (US); Brian E. Higginbotham, Tullahoma, TN (US)

(73) Assignee: Worth, Inc., Tullahoma, TN (US)

( * ) Notice: Subject to any disclaimer, the term of this patent is extended or adjusted under 35 U.S.C. 154(b) by 0 days.

(21) Appl. No.: 09/559,284

(22) Filed: Apr. 27, 2000

Related U.S. Application Data

(60) Provisional application No. 60/166,776, filed on Nov. 22, 1999.

(51) Int. Cl.[7] ..... A63B 59/06
(52) U.S. Cl. ..... 473/566; 473/520
(58) Field of Search ..... 473/564–568, 473/457, 519, 520

(56) References Cited

U.S. PATENT DOCUMENTS

| | | | | |
|---|---|---|---|---|
| 1,509,733 A | | 9/1924 | Langford | |
| 2,967,710 A | * | 1/1961 | Carlson | 473/567 |
| 3,861,682 A | | 1/1975 | Fujii | |
| 3,941,380 A | | 3/1976 | Lacoste | |
| 3,963,239 A | * | 6/1976 | Fujii | 473/519 |
| 5,593,158 A | * | 1/1997 | Filice et al. | 473/520 |
| 5,624,114 A | | 4/1997 | Kelsey | |
| 5,655,980 A | | 8/1997 | Nashif et al. | |
| 5,676,610 A | * | 10/1997 | Bhatt et al. | 473/566 |
| 5,692,971 A | | 12/1997 | Williams | |
| 5,711,728 A | | 1/1998 | Marcelo | |
| 5,759,113 A | | 6/1998 | Lai et al. | |
| 5,772,541 A | | 6/1998 | Buiatti | |
| 5,816,963 A | * | 10/1998 | Brooks et al. | 473/564 |
| 5,842,933 A | | 12/1998 | Lewis | |
| 5,899,823 A | * | 5/1999 | Eggiman | 473/566 |
| 5,964,673 A | * | 10/1999 | MacKay, Jr. | 473/566 |
| 6,022,282 A | | 2/2000 | Kennedy et al. | |
| 6,077,178 A | * | 6/2000 | Brandt | 473/520 |
| 6,146,291 A | * | 11/2000 | Nydigger | 473/566 |
| 6,322,463 B1 | * | 11/2001 | Forsythe et al. | 473/566 |
| 6,485,382 B1 | * | 11/2002 | Chen | 473/566 |

FOREIGN PATENT DOCUMENTS

| | | |
|---|---|---|
| JP | 2215481 | 8/1990 |
| JP | 2224774 | 9/1990 |
| JP | 6126359 | 5/1994 |
| JP | 7096055 | 4/1995 |

OTHER PUBLICATIONS

Exhibit A is a brochure entitled Louisville Slugger which to the best of Applicant's knowledge was published in about May of 1999.
Performance Measurement of Baseball Bats (1993).
"Only the Finest New York Ash" A Brief History of the Baseball Bat (1994).
Taking a Swing With Three–Piece Bats (1995).
Batting the Ball (1962).
Models of Baseball Bats (1989).
The Sweet Spot of a Baseball Bat (1985).
Baseball Bat Inertial and Vibrational Characteristics and Discomfort Following Ball–Bat Impacts (1994).
How Sweet It Is!!—Can Your Baseball Bat Measure Up? (1994).
The Physics of Baseball (1987–1989).

* cited by examiner

*Primary Examiner*—Mark S. Graham
(74) *Attorney, Agent, or Firm*—Waddey & Patterson; Lucian Wayne Beavers

(57) ABSTRACT

An improved design for a tubular aluminum ball bat or light sports implement is provided. The bat includes a handle portion, a barrel portion having a circumferential outer wall, and a transition portion joining the handle portion and the barrel portion. A structural bridge is located within the bat and is attached to and spans the circumferential outer wall. The structural bridge modifies the vibrational response of the bat so as to increase the size of the sweet spot of the bat and provide more effective energy transfer from the bat to a ball upon striking the ball with the bat.

40 Claims, 17 Drawing Sheets

Vibration amplitude versus time for a bat struck in the barrel region (Noble and Walker, 1993)

Displacement versus time curves for the baseline model bat. The bat was impacted at node 306 with a force of 100 pounds. The impact lasted for 0.035 seconds.

Displacement versus time curves for the bat with a geometrical change centered at 31.54% from the barrel end of the bat. The bat was impacted with a 100-pound force at node 306. The impact lasted for 0.035 seconds.

Displacement versus time curves for the bat with a geometrical change centered at 40.36% from the barrel end of the bat. The bat was impacted with a 100-pound force at node 306. The impact lasted for 0.035 seconds.

Combined Displacement Versus Time Curves at Node 306 for the Baseline Model Bat, the Bat With a Geometrical Change Centered at 31.54%, and the Bat With A Geometrical Change Centered at 40.36%

Displacement versus time curves for the bat with a wall thickness of 0.05 inches and containing a geometrical change centered at 31.54% from the barrel end of the bat. The bat was impacted at node 306 with a 100-pound force. The impact lasted for 0.035 seconds.

Displacement versus time curves for the bat with a wall thickness of 0.05 inches and for the bat with a wall thickness of 0.1inches. Both bats contain a geometrical change at 31.54% from the barrel end of the bat.

Experiment setup for measuring the sound amplitude of a bat after impact.

Fourier transform of the sound amplitude for the baseline model bat. The energy is distributed over many frequencies.

Fourier transform of the sound amplitude for the bat with a geometrical change centered at 31.54% from the barrel end of the bat. Most of the energy is contained in a single specific frequency.

TUBULAR SPORTS IMPLEMENT WITH INTERNAL STRUCTURAL BRIDGE

This application claims benefit of previously filed provisional application Ser. No. 60/166,776 of Ahmad D. Vakili, entitled "Tubular Sports Implement With Internal Structural Bridge" filed on Nov. 22, 1999, the details of which are incorporated herein by reference.

BACKGROUND OF THE INVENTION

1. Field of the Invention

The present invention relates generally to the design of tubular sports implements, such as baseball bats or golf club shafts, and more particularly to such an instrument which is designed to reduce unwanted vibration in the implement and to increase the hitting effectiveness of the instrument.

2. Description of the Prior Art

There have been a number of attempts in the prior art to reduce unwanted vibrations in implements such as bats and golf clubs. One such example is that shown in U.S. Pat. No. 5,711,728 to Marcello, which describes a wooden ball bat having externally protruding ridges or knurls above the handle of the bat.

Another approach is shown in U.S. Pat. No. 5,772,541 to Bujatti which discloses the use of an elastomeric vibration damping member which is freely movable within a chamber defined on the implement.

U.S. Pat. No. 5,759,113 to Lai et al. discloses the use of longitudinal strips of visco-elastic damping material.

U.S. Pat. No. 3,941,380 to Lacoste and U.S. Pat. No. 5,655,980 to Nashif et al. both disclose the use,of cantilevered vibrational damping devices.

U.S. Pat. No. 1,509,733 to Langford discloses a two piece wooden bat having an elastomeric damping ring located between the two sections.

U.S. Pat. No. 5,624,114 to Kelsey discloses a ball bat shock dampener which attaches to the knob end of the bat.

U.S. Pat. No. 5,842,933 to Lewis discloses a grip for a golf club or the like having a built in shock absorber comprised of an elastomeric plug received in the handle end of the implement and attached to the external grip.

U.S. Pat. No. 5,692,971 to Williams discloses a shock absorbing insert for use in a golf club or the like.

Thus, it is seen that there is a continuing desire in the art to find improved techniques for tuning the vibrational response of a ball bat, golf club or other such sports implement utilized to strike a ball. The present invention provides a new and improved technique for accomplishing such a result.

SUMMARY OF THE INVENTION

A tuned sports implement is provided which includes an impact portion constructed to impact a ball, a handle portion constructed to be held by a human hand, a hollow structural member including an outer wall defining an interior space, the structural member connecting the impact portion and the handle portion, and a structural bridge received in the interior space of the structural member and attached to the outer wall. The structural characteristics of the bridge are selected to reduce wasted bending energy and increase energy transfer between the implement and the ball.

Preferably, the handle and impact portions are hollow and are integral portions of the structural member.

In one embodiment, the structural member is a bat constructed of aluminum.

The structural bridge may be attached to the wall be several means. One technique for attaching the structural bridge to the internal surface of the wall is by adhesive. The adhesive will provide a means for dampening vibration of the implement upon striking a ball.

Another technique for attaching the bridge to the wall of the implement is by welding the bridge to the implement.

When the improvements of the present invention are applied to the design of a baseball bat, it results in a bat in which the size of the sweet spot of the bat is increased.

The structural characteristics of the bridge are selected to reduce the amount of energy which is transferred into the first and second vibrational modes of the bat, and to increase the amount of energy in the third vibrational mode of the bat. Because of the bridge, resonance interaction between the bat and the ball is increased.

The invention may also be described as a hollow aluminum ball bat including a handle portion, a barrel portion having a circumferential outer wall, a transition portion joining the handle portion and the barrel portion, and a structural bridge located within the barrel portion and attached to and spanning the circumferential outer wall.

It is therefore an object of the present invention to provide an improved sports implement in which the amount of energy transferred from the implement to a ball struck by the implement is increased.

Still another object of the present invention is the provision of a tubular sports implement having a structural bridge received therein for modifying the vibration characteristics of the implement.

Still another object of the present invention is the provision of a sports implement having reduced vibration in the handle when the implement strikes a ball.

Still another object of the present invention is the provision of a ball bat having an enlarged sweet spot.

And yet another object of the present invention is the provision of a sports implement which has a resonance interaction between the implement and a ball which is struck by the instrument.

And another object of the present invention is the provision of a sports implement constructed to tune the implement's third vibrational mode to that corresponding to a ball to be used with the instrument.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

The present invention provides a new design for a baseball or softball bat or other sports implement such as a golf club shaft, which aids in controlling the vibrational response of the implement when it strikes a ball. Although the invention is disclosed herein in a specific embodiment of a ball bat, it will be appreciated that the principles disclosed may be applied to other sports or non-sports implements.

Figure 1:
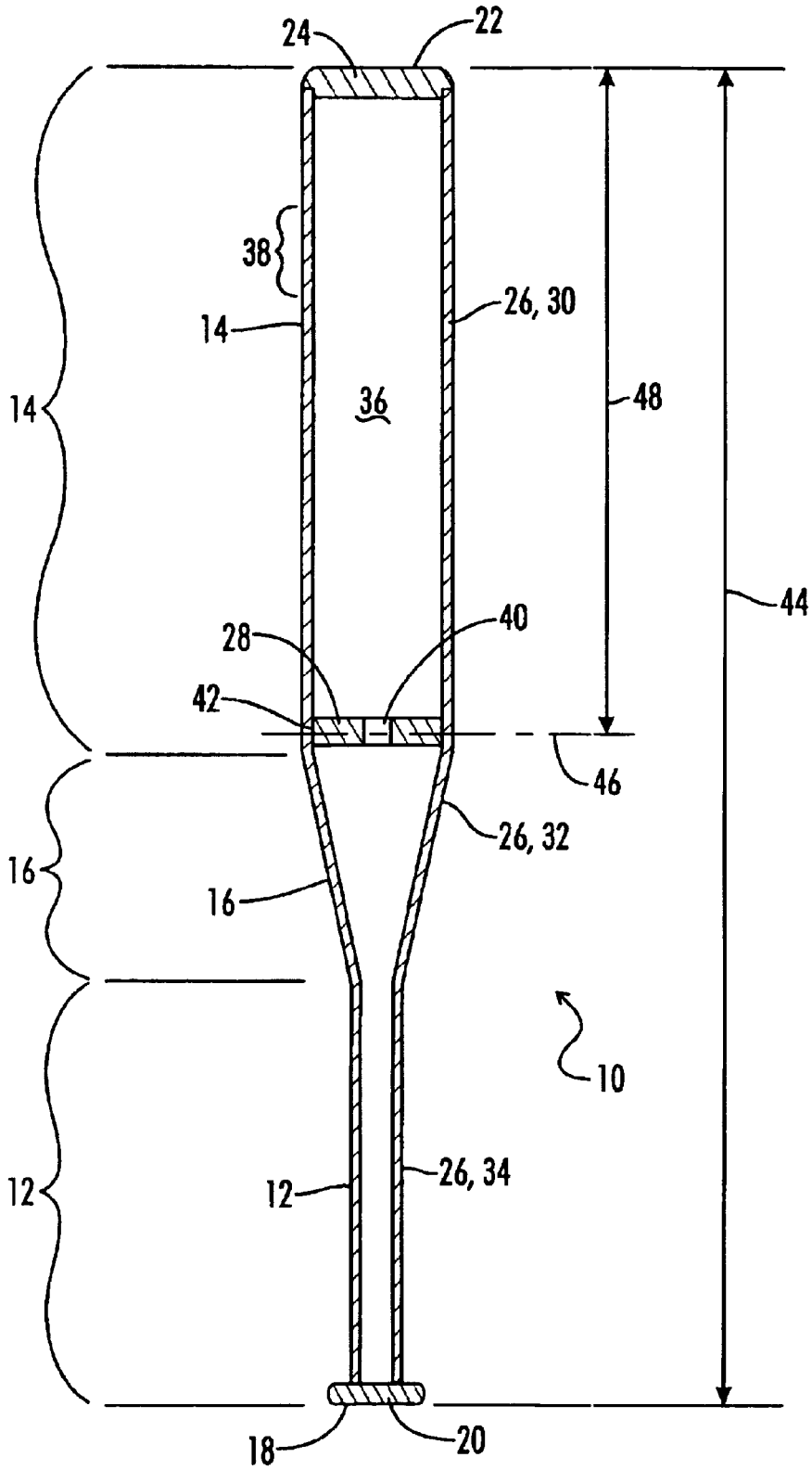
FIG. 1 is a cross-sectional view of the bat of the present invention.
Figure 2:
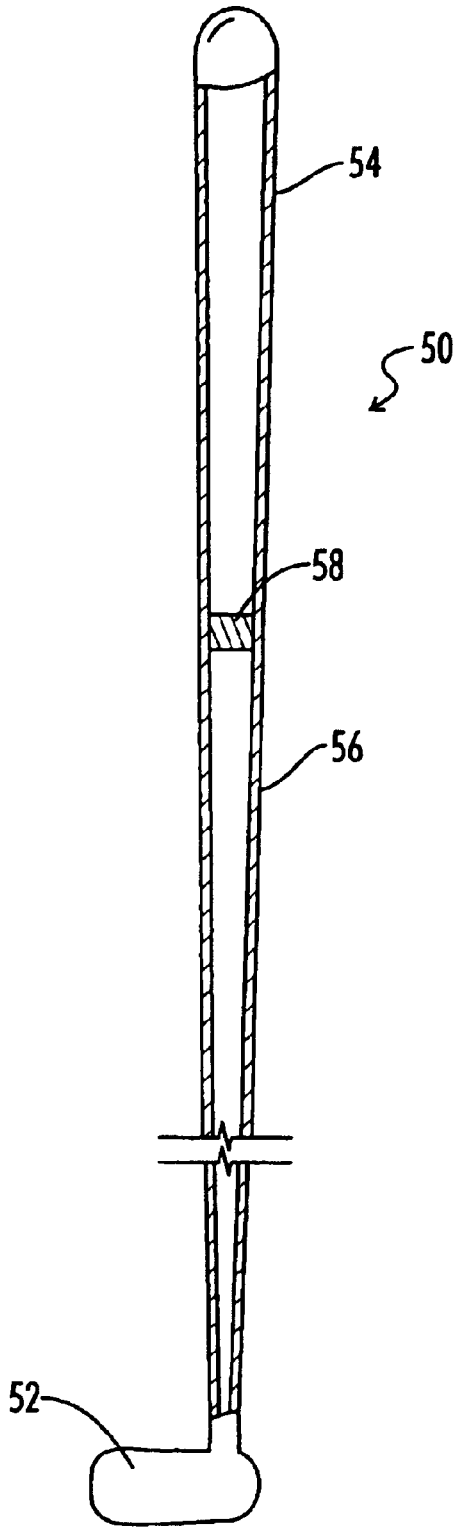
FIG. 2 is a cross-sectional view of a golf club utilizing the present invention.

Referring now to FIG. 1, a hollow aluminum baseball bat is shown and generally designated by the numeral 10. The bat 10 can be generally described as including a handle portion 12, a barrel portion 14, and a tapered transition portion 16, joining the handle portion 12, and barrel portion 14.

The bat 10 includes a handle end 18 defined by a knob 20 and a barrel end or impact end 22 defined by an end cap 24.

The barrel portion 14 can be described as including a circumferential outer wall 26 which is circular in cross-section. The circumferential outer wall 26 includes a barrel wall portion 30, transition wall portion 32, and handle wall portion 34.

The present invention provides a structural bridge 28 which is located within the bat and which is attached to the circumferential outer wall.

The structural bridge 28 may, for example, be a disc constructed from aluminum having an outside diameter of 1.84" and a thickness of ⅜" inches.

The bat 10 may be more generally described as a tuned sports implement 10. The tuned sports implement 10 can be described as a hollow structural member 14, 16, 12 including an outer wall 26 defining an interior space 36. The implement 10 includes an impact portion which can be described as including the sweet spot 38 of the barrel 14. The implement 10 also includes the handle portion 12. The structural bridge 28 can be described as being received in the interior space 36 of the structural member 14, 16, 12 and attached to the outer wall 26. The structural characteristics of the bridge 28 are selected to increase energy transfer between the implement 10 and a ball struck thereby.

The structural bridge 28 in one embodiment is a structural ring 28 having a central bore 40 defined therethrough. The structural bridge 28 may also be formed as a solid disc. In another embodiment described below with regard to FIGS. 17 and 18, the ring may be a thin walled tubular ring.

The structural bridge 28 may be attached to the outer wall 26 of bat 10 in a variety of ways.

One manner of attaching the structural bridge 28 is by the application of an adhesive at the annular interface between the outer wall 26 and the outer edge of the structural bridge 28. The adhesive material may, for example, be a two-part epoxy blend or a two-part urethane blend.

The use of such an adhesive provides a further means for dampening vibration of the bat 10 upon striking a ball, in addition to the change in vibrational characteristics which is provided by the mere presence of the structural bridge 28.

The bridge 28 is used to provide a geometrical change such that the natural vibration modes of the bat 10 are changed. Details of the frequency changes resulting from this geometrical change are further described below. As noted, however, the manner in which the bridge 28 is attached to the outer wall 26 of the bat 10 may further effect the vibrational response of the bat. The use of an adhesive or other resilient material introduces a level of dampening into the bat. Furthermore, if the bridge 28 is made of materials with different properties than the bat material, the overall bat vibration properties will be different. The differences will be due to the effective damping introduced at the interface 42 between the bridge 28 and the outer wall 26 of bat 10. This damping effect may be exploited to obtain the desired level of frequency and amplitude.

Another manner of attaching the bridge 28 to the barrel 26 is by welding of the bridge 28 to the barrel 26.

Figure 10:
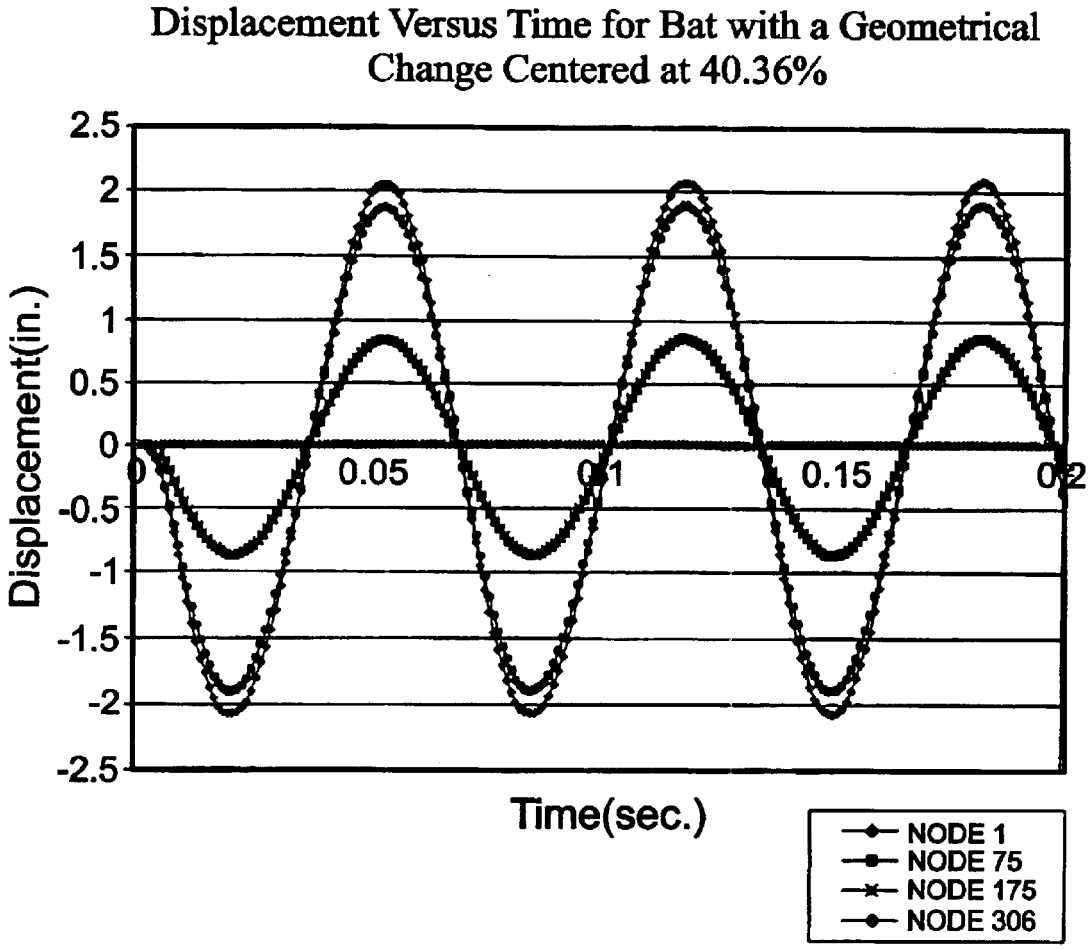
FIG. 10 is a displacement versus time curve for a bat modeled with a structural bridge located at 40.36% of the length from the barrel end.

As shown in FIG. 10, the bat 10 has a length 44 from the handle end 18 to the barrel end 22. A centerline 46 of the structural bridge 28 is located a distance 48 from the barrel end 22.

Figure 19:
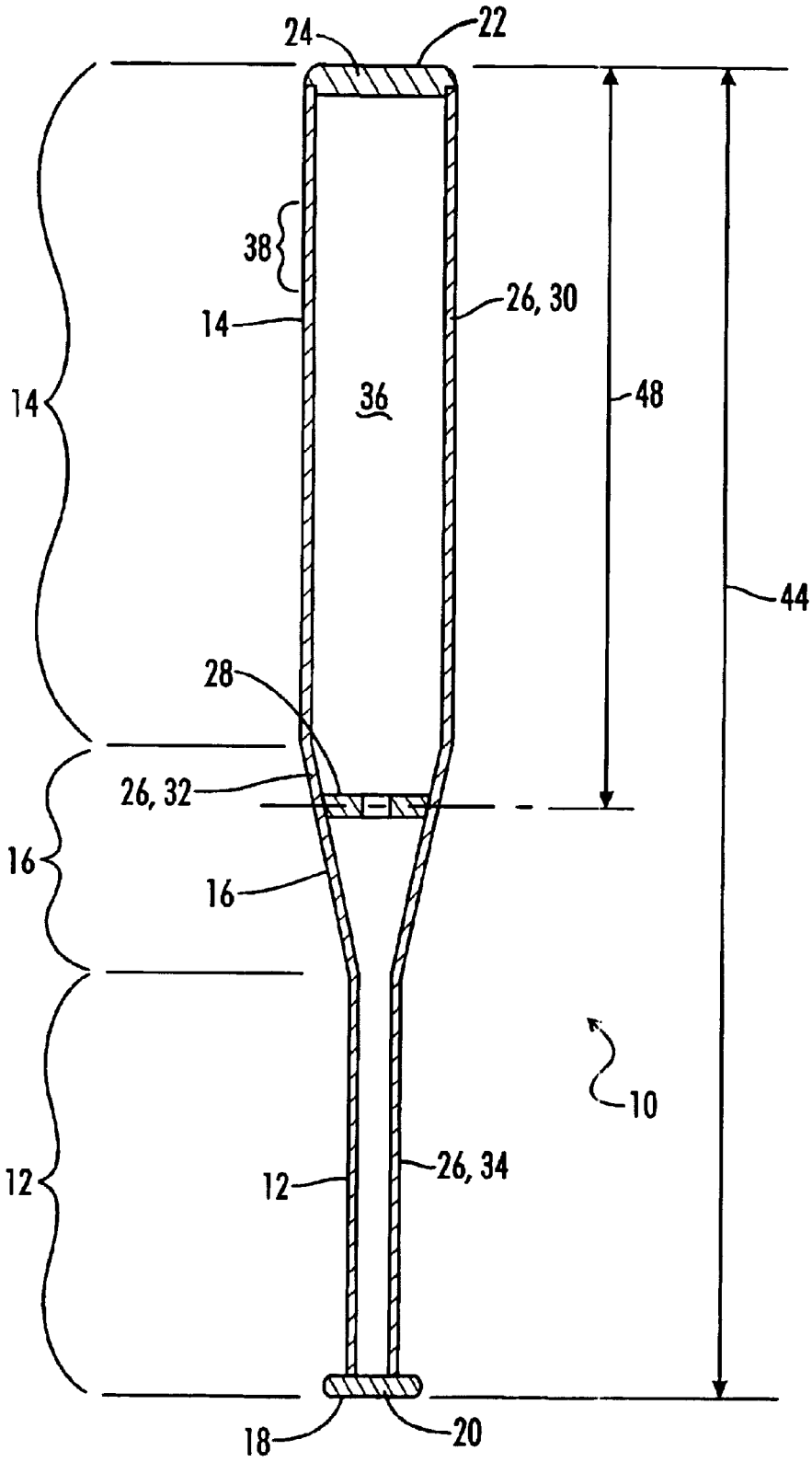
FIG. 19 is a view similar to FIG. 1, showing a disc shaped structural bridge located in the transition portion of the bat.
Figure 20:
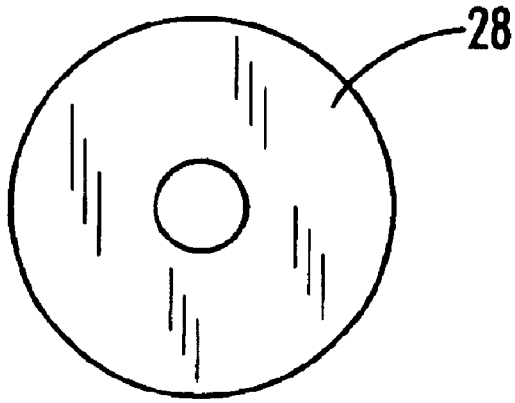
FIG. 20 is a plan view of a solid disc.
Figure 21:
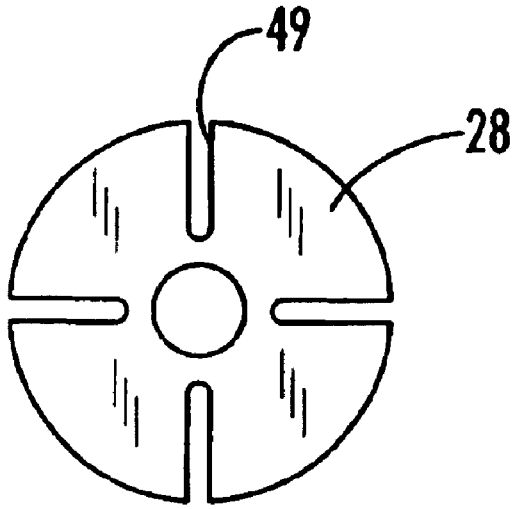
FIG. 21 is a plan view of a segmented disc.

FIG. 19 shows the bat 10 having a structural bridge 28 located in the transition portion 16. As seen in FIG. 20 and 21 the structural bridge 28 may be solid as shown in FIG. 20, or it may be segmented by radial slots 49 as shown in FIG. 21.

Figure 3:
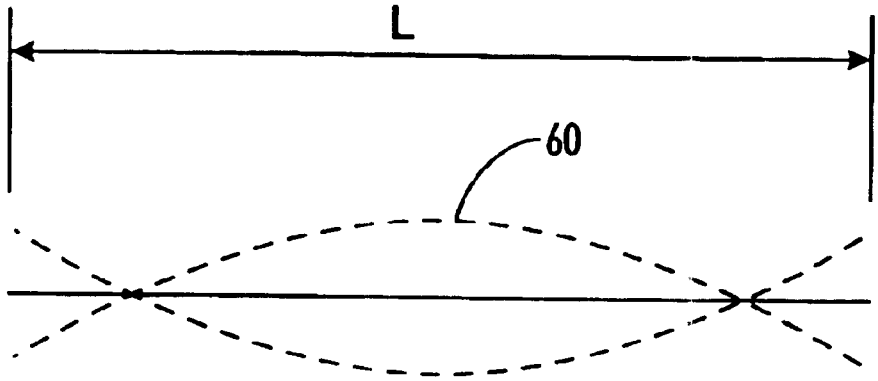
FIG. 3 is a schematic illustration of a first mode of vibration of a beam with free ends.
Figure 4:
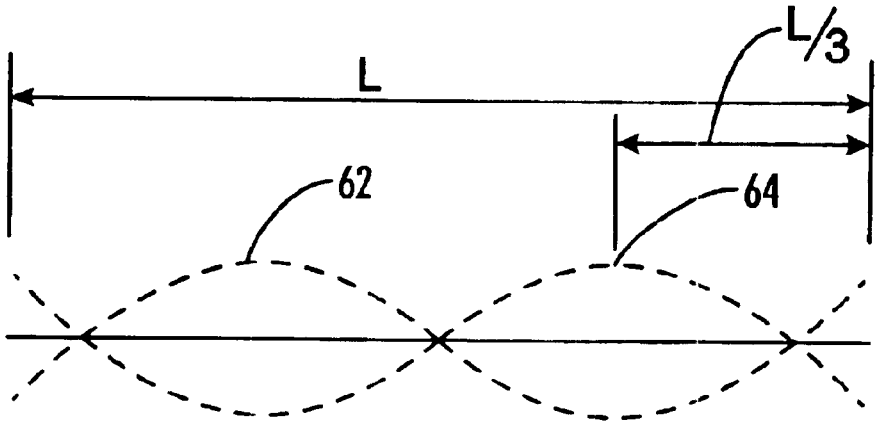
FIG. 4 is a schematic illustration of a second mode of vibration of a beam with free ends.
Figure 5:
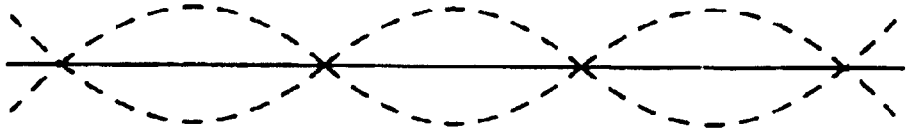
FIG. 5 is a schematic illustration of a third mode of vibration of a beam with free ends.

Referring now to FIGS. 3, 4 and 5, schematic illustrations are there shown of the first, second and third modes of vibration of a simple beam with free ends. A bat, such as the bat shown in FIG. 1, may in many respects be modeled as such a beam with free ends. It is also recognized that to some extent the bat could also be modeled as a beam with one fixed end. It will be understood by those skilled in the art, however, that the performance of a real bat will be somewhat of a blend of a beam with two free ends and a beam with one fixed end, and in any event, the bat will exhibit vibrational response to impact which includes vibrations having the characteristics of the first mode, second mode and third mode illustrated in FIGS. 3, 4 and 5.

It is known that the vibration of the handle 12 of the bat 10 which is felt by the batter and which is sometimes referred to as a "stinging" sensation to the batter's hands is primarily due to vibrations of the first and second mode. It is also known that the primary vibrational mode of energy transfer from the bat to the ball which has been struck is vibration of the third mode.

The present invention is directed to two different, but related, concepts which both improve the performance characteristics of the bat. First, the structural characteristics of the bridge 28 may be selected so as to reduce vibration in the first and second modes, and thus, to reduce the stinging sensation felt by the batter.

A second objective is to selectively tune the bat so that the resonance frequency of its third mode of vibration will be similar to the natural frequency of the ball which is being struck, thus aiding in the transfer of energy from the bat to the ball.

For example, a conventional single wall aluminum baseball bat typically has its third mode of vibration having a resonance of approximately 1800 Hz. The natural frequency of a softball, on the other hand, is generally in the range of 1100 to 1300 Hz. By selective tuning of the bat through use of the structural bridge 28, as further described below, the frequency response of the bat is modified so that its third mode of vibration will be in the range of 1100 to 1300 cycles per second, thus coinciding with the natural frequency of the ball with which the bat is to be used.

It has also been determined that the preferred location of the structural bridge in order to reduce the first and second modes of vibration will be to place one or more such bridges at the anti-node of vibration. For the first mode of vibration shown in FIG. 3, the anti-node 60 is the center point of the bat which corresponds to the location of maximum vibrational amplitude. The nodes are points of no movement.

For the second mode of vibration illustrated in FIG. 4, there are two anti-nodes 62 and 64, each located approximately one-third the distance from the end of the bat, and again, the placement of a structural bridge at one or both of those anti-nodes will have the maximum effect in reducing that vibrational mode of the bat.

It is noted that the various modes of vibration illustrated in FIGS. 3, 4 and 5 are modes of beam vibration. This is contrasted to various modes of shell vibration, such as the well known trampoline effect, which is a mode of shell vibration of a bat.

As is further explained below, in actual practice a selected location for the structural bridge will be based somewhat upon trial and error in order to provide an optimum combination of reduction of the first and second modes of vibration and simultaneous tuning of the third mode of vibration to the desired frequency response.

The structural characteristics of the bridge 28 which contribute to its effect upon the vibrational response of the bat 10 include characteristics such as the dimensions, material, mass and location of the bridge 28. The structural characteristics of the bridge 28 are chosen to tune the resonant frequency of the bat to a selected range, and preferably to tune the bats third vibrational mode to a selected range which is in the range from 1100 to 1300 cycles per second.

The desired result is to provide a resonance interaction between the bat 10 and the ball which it is to strike. This can also be described as increasing the size of the sweet spot 38 of the bat 10.

The presence of the structural bridge 28 has been found to reduce mode one and mode two vibration of the bat 10 which results in an increase in the amount of energy directed to mode three vibration of the bat, which is the mode primarily responsible for effective hitting of a ball with the bat.

In the embodiment illustrated in FIG. 10, the structural bridge 28 is located within the barrel portion 14 adjacent a junction between the barrel portion 14 and the transition portion 16 of the bat. It will be understood, however, that the structural bridge 28 could also be located in the transition portion 16, or in some instances even in the handle portion 12. Preferably, the structural bridge 28 is located in either the barrel portion 14 or transition portion 16 which may be generally described as locating at least one structural bridge 28 in at least one of the barrel portion 14 and the transition portion 16. It will also be understood that more than one structural bridge 28 may be utilized in a bat 10.

Figure 11:
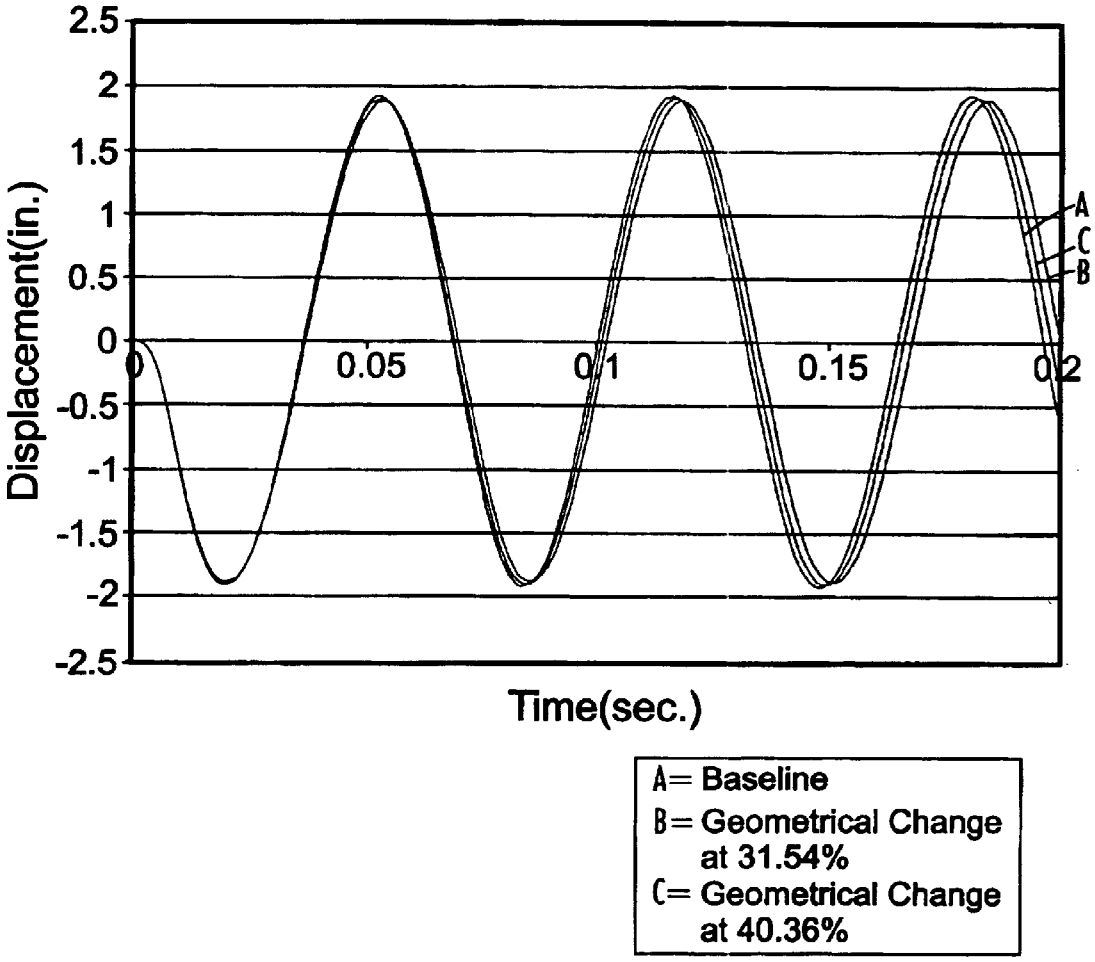
FIG. 11 is a combined displacement versus time curve for the three bats modeled in FIGS. 8, 9 and 10.

FIG. 11 illustrates the present invention as embodied in a golf club 50. The golf club 50 may be described as a tuned sports implement 50 having an impact portion 52, otherwise known as the head 52 of the club, and having a handle portion 54. The club includes an elongated hollow tubular shaft 56 of which the handle portion 54 is an integral part, and to which the head 52 is attached. The structural bridge 58 of the present invention is located within the tubular shaft 56 and is otherwise designed in accordance with the principles as set forth herein.

The following materials provide a description of the experimental analysis which has been performed to confirm and explain the desired performance of the structural bridge of the present invention.

The problem arises in finding the optimum size and location for the structural bridge. In order to find the optimum location, a trial and error method can be used or with the help of computational tools a good estimate can be obtained. Structural bridges of different sizes may be centered at varying locations in the bat. Analysis must then be performed on the bat for each location of the structural bridge. Once the optimal location for the structural bridge is found, the result is reduced vibration in the handle hence minimum sting is felt in the batter's hands. Therefore, the addition of this optimally placed structural bridge will, in a practical sense, increase the size of the sweet spot 38 of the bat.

Figure 6:
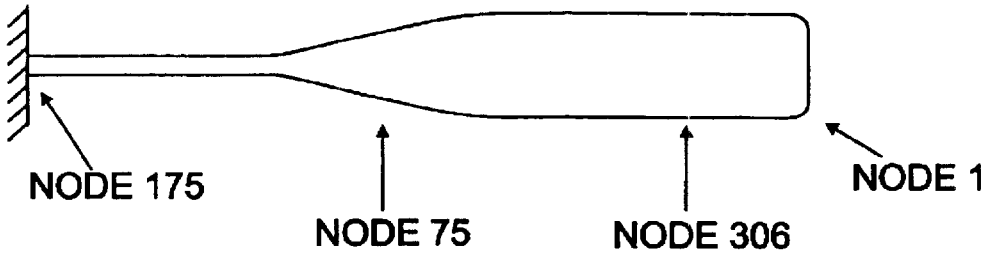
FIG. 6 is a schematic illustration of the numerical model used to verify the effectiveness of the present invention.

The bat 10 was modeled using a finite element program known as COSMOS/M. The model is illustrated in FIG. 6, and is based upon the assumption that the handle end is fixed and the barrel end is free. The bat as modeled had an outside barrel diameter of 2.75 inches and an outside handle diameter of 0.855 plus or minus 0.006 inches. The wall thickness varies from 0.078 plus or minus 0.005 inches to 0.110 plus or minus 0.004 inches. For the modeling, the wall thickness was assumed to be 0.1 inches throughout the length of the bat. This assumption was made because the bat was modeled as a thin shell with a shell thickness of 0.1 inches. The bat's material properties were assumed to be as follows:

Material Properties

Modulus of elasticity =1.0 e+7 lbs/in$^2$

Poisson's ratio =3.3 e−1 in/in

Shear modulus =3.9 e+6 lbs/in$^2$

Coefficient of thermal expansion =1.3 e−5 in/(in° F.)

Density =2.5 e−4 lbs sec$^2$/in$^4$

Specific heat =8.3 e+1 BTU in/lbs sec$^2$/° F.

Thermal conductivity in the global X - direction =2.7 e−3 BTU/in sec° F.

The next step in the modeling was to select the location for the structural bridge 28. Modeling was run utilizing a distance 48 which was located at 31.54%, 40.36%, 49.19% and 58.01% of the length 44 from the barrel end 22.

Utilizing the COSMOS modeling system, a linear static analysis, a frequency analysis and a post-dynamic analysis were all performed on the bats with the structural bridges located at the four locations described.

After a static analysis was performed on the bats, a frequency analysis was performed on all the bats: the baseline model bat, the bat with no structural bridge, and the four bats with the structural bridges in place. A separate analysis was made for each new location of the structural bridge. For example, there was a complete natural frequency analysis for the bat with structural bridges centered at 31.54% and then there is a complete natural frequency analysis for a bat with a structural bridge centered at 40.36% as well as 49.19% and 58.01%. Twenty modes were calculated for each bat. It is noted that the structural bridge may also be described as geometric change in the cross-section of the bat.

After the frequency analysis was performed, a post-dynamic analysis was also performed on the bat. The results from the previous frequency analysis are used in this analysis. For the post-dynamic analysis, a time history analysis was used. In this type of analysis, the number of time steps and the iteration size for the time step must be chosen. For this particular analysis the time step chosen was 0.001 seconds and there were 200 time steps. Therefore, the time history had duration of 0.2 seconds. A load of 100 pounds was applied at 0.005 seconds. At a time equal to 0.0085 seconds the load was completely removed. The force was in contact with the bat for 0.0035 seconds because this is approximately the length of time a ball is in contact with the bat. For the results, the nodes or numerical grid points that are being studied by the analysis are chosen before the analysis is performed. Nodes were chosen at the tip of the barrel, the point of contact with the force, the transition region and the tip of the handle. The Newmark-Beta integration method was chosen and then the post dynamic time history analysis was started.

Results of the Linear Static Analysis

The first type of analysis that was performed on the baseline model bat, the bat without any form of structural bridge was a linear static analysis. A linear static analysis can be used in order to check displacement of the bat and the stiffness of the bat. This same analysis was performed on one of the bats that contained a structural bridge. The results from the baseline model bat were compared to the static results of the bat with the geometrical change. These results can be seen in Table 1.

TABLE 1

Bat Displacements

| Node | Displacements Z Dir. (in.) Base Model | Geometrical change at 31.54% |
|---|---|---|
| 1 | −5.084e+00 | −5.084e+00 |
| 75 | −2.103e+00 | −2.103e+00 |
| 175 | 0.0 | 0.0 |
| 306 | −4.646e+00 | −4.646e+00 |

Node 1 is located at the barrel end of the bat. Node 75 is located in the bat's transition region and the tip of the handle is represented by node 175. The ball impacts the bat at node 306. The location of these nodes on the bat can be seen in FIG. 6.

It is noted that the term "node" as used to describe the numerical model as illustrated in FIG. 6, is different from the "node" of a given mode of vibration as illustrated in FIGS. 3, 4 and 5.

When a structural bridge is added to the bat, there is an increase in the bat's mass. From the results in Table 1, it can be seen that the displacements of the two bats are the same. This shows that a bat's stiffness is not changed when a structural bridge is added to the bat.

Since this analysis was just used as a method for checking to see if the addition of a structural bridge added stiffness to the bat, it was only performed on one of the bats with a structural bridge. There was no need to repeat the analysis for the other bats because if the addition of the structural bridge added only mass and not stiffness in one bat, then the other bats would experience the same effect with the addition of a structural bridge.

Results Of Frequency Analysis

After it was determined that the addition of the structural bridge only added mass and not stiffness, a frequency analysis was performed on both the baseline model and four different bats with structural bridges centered at different locations. The locations for the structural bridge are 31.54%, 40.36%, 49.19% and 58.01%. All percentages are measured from the barrel end of the bat. For all five bats, twenty modes of the natural frequencies were calculated. The subspace iteration method was used to calculate these frequencies. It was decided to only use the first twenty natural frequencies because these frequencies sufficiently satisfy the elastic behavior of a bat after it has been struck by a ball. These twenty natural frequencies for all the bats can be seen in Table 2.

These results were then studied and comparisons were made. From the results, it can be seen that the various locations of the structural bridge affect the bat's various frequencies differently. For a structural bridge centered at 31.54%, the first ten frequencies are lower than for the baseline model bat. The first two frequencies are of special interest in this study. Of all four bats studied, the first two frequencies are the lowest for the bat with a structural bridge centered at 31.54% from the barrel end. A change in the first two frequencies also changes the response of the bat after impact with the ball. This is the intended effect for the location of the structural bridge in a bat.

TABLE 2

Natural frequencies for baseline model bat and for bats with structural bridge centered at 31.54%, 40.36%, 49.19% and 58.01% from the barrel end.

| Frequency Number | Modification @ 31.54% | Modification @ 40.36% | Modification @ 49.19% | Modification @ 58.01% |
|---|---|---|---|---|
| 1 | 1.89 | 0.85 | 0.30 | 0.05 |
| 2 | 1.89 | 0.84 | 0.30 | 0.05 |
| 3 | 1.18 | 1.11 | 0.97 | 0.61 |
| 4 | 0.99 | 1.84 | 1.92 | 1.35 |
| 5 | 1.14 | 1.29 | 1.12 | 0.73 |
| 6 | 1.43 | 1.01 | 0.05 | 0.08 |
| 7 | 1.39 | 0.99 | 0.02 | 0.07 |
| 8 | 2.47 | 1.44 | 0.64 | 0.21 |
| 9 | 1.14 | 0.05 | 0.84 | 1.51 |
| 10 | 1.15 | 0.05 | 0.84 | 1.51 |
| 11 | 5.97 | 0.28 | 0.01 | 0.0 |
| 12 | 5.98 | 0.28 | 0.01 | 0.00 |
| 13 | 0.09 | 0.88 | 1.35 | 0.05 |
| 14 | 0.06 | 1.10 | 1.39 | 0.04 |
| 15 | 18.00 | 6.15 | 0.03 | 0.00 |
| 16 | 33.14 | 6.15 | 0.03 | 0.00 |
| 17 | 14.01 | 0.78 | 0.14 | 0.51 |

TABLE 2-continued

Natural frequencies for baseline model bat and for bats with structural bridge centered at 31.54%, 40.36%, 49.19% and 58.01% from the barrel end.

| Frequency Number | Modification @ 31.54% | Modification @ 40.36% | Modification @ 49.19% | Modification @ 58.01% |
|---|---|---|---|---|
| 18 | 0.45 | 1.73 | 0.02 | 1.34 |
| 19 | 0.68 | 1.29 | 0.26 | 1.08 |
| 20 | 13.32 | 14.34 | 0.92 | 0.0 |

There is a unique deformed shape of the bat at each natural frequency. For both bats, the first and second modes are simple bends. Since the bat is clamped in the model, these first two frequencies are lower in value than if the bat were free. When the bat is held clamped at the handle, there is a longer moment arm about which the bat has to swing. As the mode number increases so does the number of nodes in the shape of the bat. For example, for modes 1 and 2, there is 1 node. For mode 3 of both bats, there are 2 nodes. This progression continues for all proceeding frequencies. Also, for the lower frequencies, the oscillations are in the bat's handle. For the higher modes of vibration for the natural frequencies, the oscillations start occurring in the barrel portion of the bat.

Use Of Other Materials For Structural Bridge

The structural bridges used in the bats in the numerical modeling were made from aluminum (almost the same material as bats). However, the composition of one of the structural bridges was made from an acrylic. The material properties of acrylic are as follows:

Modulus of elasticity=3.5 e+5 lbs/in$^2$

Poisson's ratio=3.5 e−1 in/in

Shear modulus=1.3 e+5 lbs/in$^2$

Coefficient of thermal expansion=2.9 e−5 in/(in° F.)

Density=1.1 e−4 lbs sec$^2$/in$^4$

Specific heat=1.4 e+2 BTU in/lbs sec$^2$ 1° F. Thermal activity in the global X-direction=2.8 e−6 BTU/in sec ° F.

This stuctural bridge was placed in a bat at 49.19% from the barrel end. A frequency analysis was performed on this bat. These results were compared to a bat with a structural bridge with a composition of aluminum centered at 49.19% from the barrel end. The results from this analysis can be seen in Table 3.

TABLE 3

Aluminum structural bridge frequency versus acrylic structural bridge frequency

| Frequency Number | Frequency percentage from Aluminum Structural Bridge | baseline frequency Acrylic Structural Bridge |
|---|---|---|
| 1 | 0.30 | 0.69 |
| 2 | 0.30 | 0.68 |
| 3 | 0.97 | 2.53 |
| 4 | 1.92 | 4.40 |
| 5 | 1.12 | 2.19 |
| 6 | 0.05 | 0.42 |
| 7 | 0.02 | 0.36 |
| 8 | 0.64 | 1.61 |
| 9 | 0.78 | 1.74 |
| 10 | 0.84 | 1.88 |
| 11 | 0.01 | 0.01 |
| 12 | 0.01 | 0.01 |
| 13 | 1.35 | 3.03 |
| 14 | 1.39 | 3.11 |
| 15 | 0.03 | 0.03 |
| 16 | 0.03 | 0.03 |

TABLE 3-continued

Aluminum structural bridge frequency versus acrylic structural bridge frequency

| Frequency Number | Frequency percentage from Aluminum Structural Bridge | baseline frequency Acrylic Structural Bridge |
|---|---|---|
| 17 | 0.14 | 0.41 |
| 18 | 0.02 | 0.07 |
| 19 | 0.26 | 0.57 |
| 20 | 0.92 | 0.92 |

From Table 3, it can be seen that the frequency for the acrylic structural bridge is lower for the first 19 modes of frequency. For mode 20, the frequency of the acrylic structural bridge was higher. These differences in frequencies between the aluminum and acrylic structural bridge are only marginal. Although the differences in the frequencies are marginal, the results of this analysis do show that the geometry of the structural bridge along with the special materials used in the structural bridge can reflect changes in the bat's frequency and this is a desired result.

Effect of Wall Thickness

For the bat, a wall thickness equal to 0.1 inches was assumed. However, for a comparison, another bat was calculated with an assumed wall thickness of 0.05 inches. A structural bridge was also placed at 31.54% from the barrel end. A frequency analysis was performed on this bat and compared to the original bat with a wall thickness of 0.1 inches. The results and comparison can be seen in Table 4.

The results from this analysis show that the wall thickness does have a pronounced effect on the natural frequency of the bat. The bat's first natural frequency is increased and the second, third and fourth natural frequencies are decreasing. There is one drawback, however, to the frequency changing with wall thickness, below a minimum wall thickness, the bat will be damaged.

TABLE 4

Percentage variations in frequency from baseline model bat for bats with different wall thickness.

| Frequency Number | Frequency percentage from 0.1 In. Wall | baseline frequency 0.05 In. Wall |
|---|---|---|
| 1 | 1.59 | 0.49 |
| 2 | 1.89 | 2.17 |
| 3 | 1.18 | 23.10 |
| 4 | 0.99 | 2.29 |
| 5 | 1.14 | 0.85 |
| 6 | 1.43 | 6.10 |
| 7 | 1.39 | 1.42 |
| 8 | 2.47 | 4.25 |
| 9 | 1.14 | 17.70 |
| 10 | 1.15 | 18.70 |
| 11 | 5.97 | 16.70 |
| 12 | 5.98 | 16.60 |
| 13 | 0.09 | 9.84 |
| 14 | 0.06 | 9.13 |
| 15 | 18.00 | 14.10 |
| 16 | 33.14 | 9.55 |
| 17 | 14.01 | 22.20 |
| 18 | 0.45 | 31.50 |
| 19 | 0.68 | 33.40 |
| 20 | 13.32 | 25.30 |

Results Of Post Dynamic Analysis

After the frequency analysis was complete, a post dynamic analysis was performed on the baseline model bat, the bat with the structural bridge centered at 31.54% and the bat with the structural bridge centered at 40.36%. The post dynamic analysis was not performed on either the bat with the structural bridge centered at 49.19% or the bat with a structural bridge centered at 58.01%. It was decided that structural bridge at these two locations were not as beneficial as the changes centered at 31.54% or 40.36%. This decision was based on the frequency analysis of each bat.

The twenty modes of the natural frequency are used in the post dynamic analysis. There are 200 iterations with 0.001 seconds as the time step; therefore the analysis lasts for 0.2 seconds. A load of 100 pounds is applied at 0.005 seconds and the load stays in contact with the bat for 0.0035 seconds. The relative displacement is calculated for this impact loading condition for 200 iterations using the Newmark-beta integration process.

Figure 7:
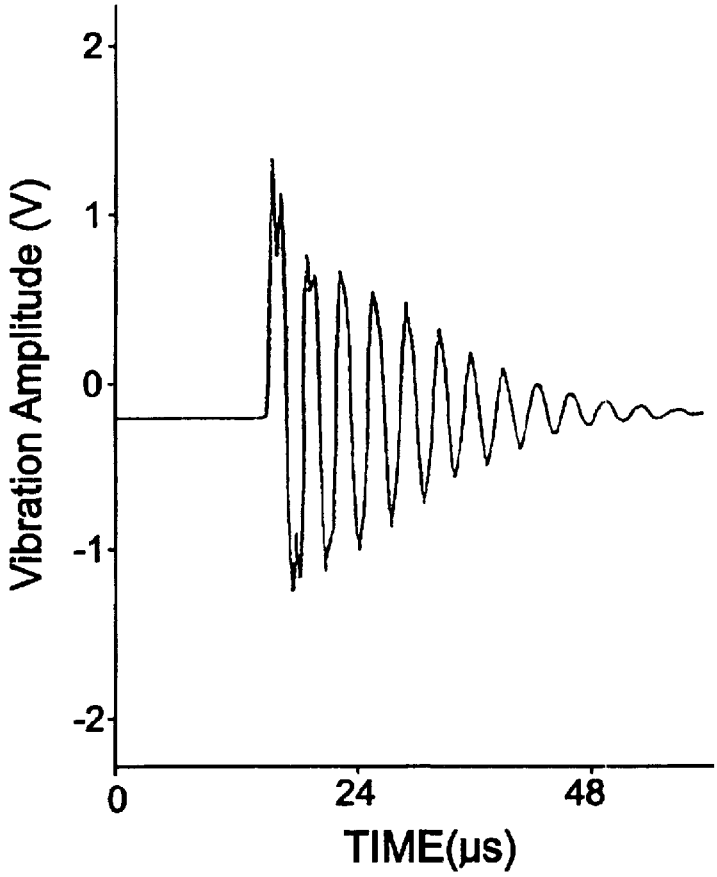
FIG. 7 (PRIOR ART)
FIG. 7 is a graphical view taken from the prior art showing vibrational amplitude versus time for a bat struck in the barrel region.

FIG. 7 (Noble and Walker 1993) shows a characteristic vibration waveform for a bat struck near the barrel end.

From FIG. 7, it can be seen that the vibration damps out around 48.0 microseconds. Similar vibrational waveform plots to those in FIG. 7 were used to study the damping affects of the geometrical changes in this analysis.

Displacement Versus Time Curves

Figure 8:
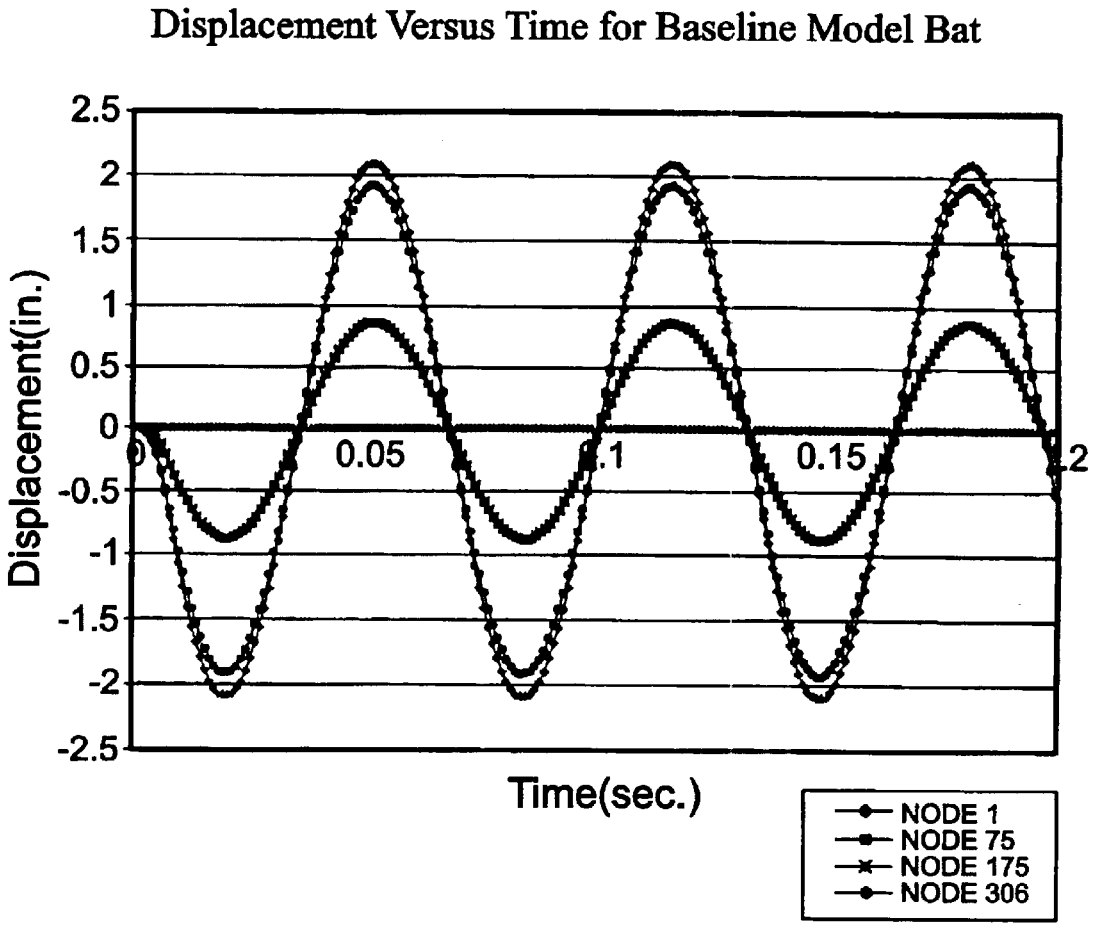
FIG. 8 is a graphical representation of displacement versus time curves for a baseline bat without a structural bridge.
Figure 9:
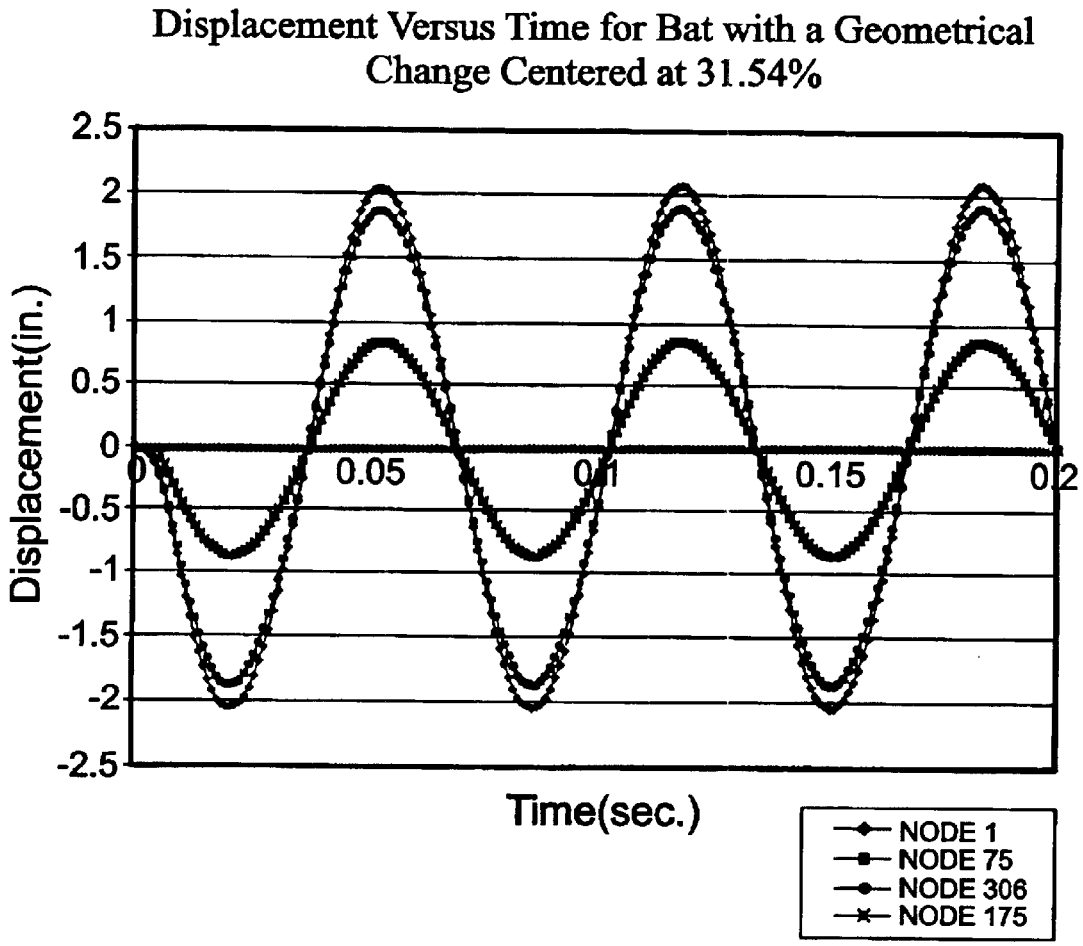
FIG. 9 is a displacement versus time curve for a bat modeled with a structural bridge located at 31.4% of the length from the barrel end.

A plot of the relative displacement versus time for the baseline model bat can be seen in FIG. 8. FIGS. 9 and 10 are plots of the relative displacement versus time for the bat with a geometrical change centered at 31.54% from the barrel end and for the bat with a geometrical change centered at 40.36% from the barrel end respectively. For each bat, the plots were made at mesh nodes 1 (tip of barrel), 75 (transition region), 175 (the tip of the handle) and 306 (place of impact).

These plots show the amplitudes and frequency of vibration for the bat after a 100-pound force lasting 0.0035 seconds has impacted it. The period is the time it takes an oscillation to repeat itself. The frequency is the reciprocal of the period of an oscillation.

For all three bats, the displacement was the greatest at node 1, which was the tip of the barrel. The next greatest area of displacement was at node 306, point of impact. Node 175 has no degrees of freedom; therefore, there was no displacement at this point.

From these figures, it can be seen that as time increases the amplitude of the oscillations gradually begins to decrease. The frequency of the oscillations also begins to decrease as time increases. This occurs in all three bats.

Although the plots for the three bats look similar, if the three plots are combined as in FIG. 11, it can be seen that there is a difference in the graphs. FIG. 11 is a displacement versus time curve at node 306 for the baseline model bat, the bat with a geometrical change centered at 31.54% from the barrel end of the bat, and the bat with a geometrical change centered at 40.36% from its barrel end.

The frequency for the bat with the structural bridge centered at 31.54% has shifted more to the right than the frequency of the other two bats. The bat with the structural bridge centered at 40.36% has a frequency that has shifted more than that of the baseline model bat. Because the displacement versus time plots at the same node for the three bats are different, it shows that the containment and placement of a structural bridge in a bat greatly affects the bat's vibration. The plots have shown that the bats containing structural bridges have amplitudes of vibration that begin to damp out quicker than the bat that does not contain a structural bridge, the baseline model bat. This shows that the placement or location of the structural bridge in the bat is also of great importance to reducing the vibrations in a bat. Therefore, an optimum location of a geometrical change in a bat would greatly optimize a bat by aiding in the reduction of vibration.

Shell Thicknes Effect

Figure 12:
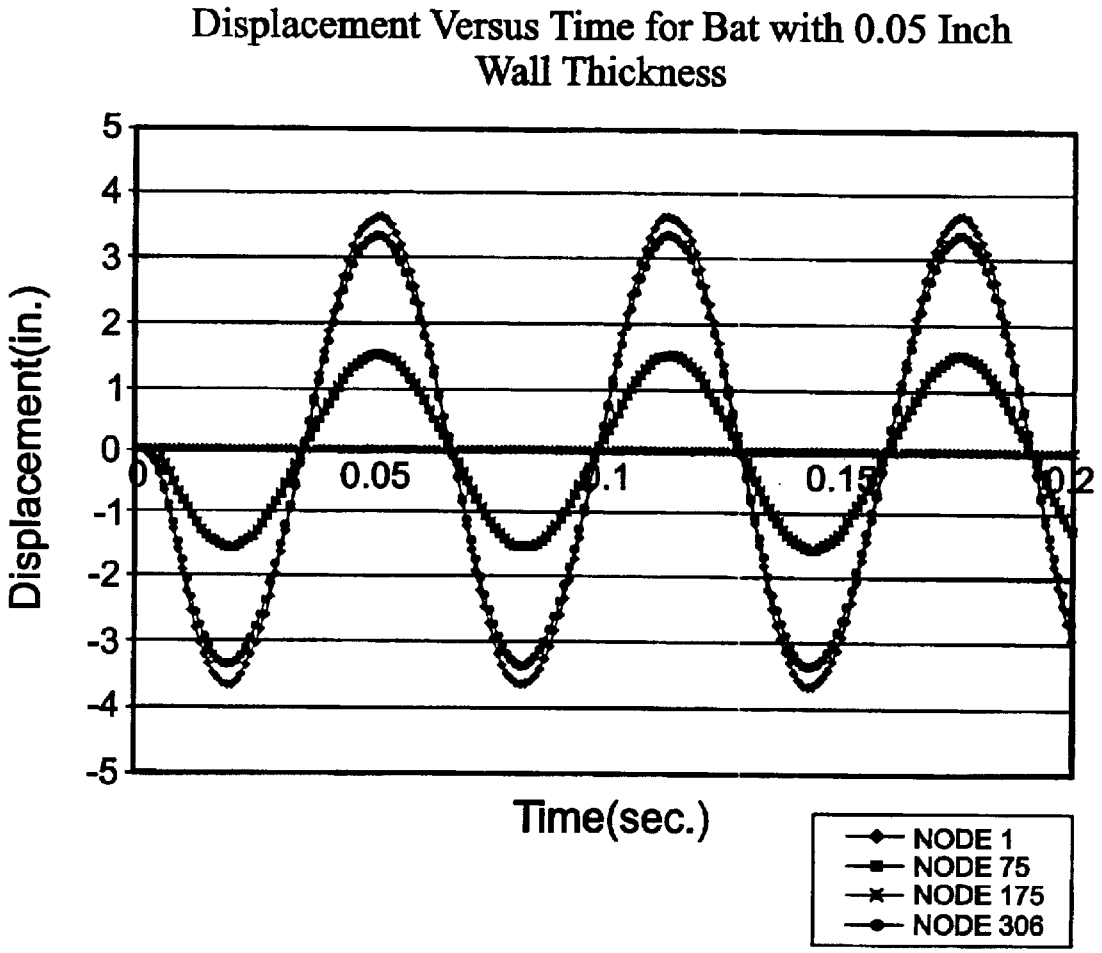
FIG. 12 is a displacement versus time curve for a bat with a wall thickness of 0.05 inches.

Once that it was decided that the structural bridge at 31.54% was the optimum place (of those studied) for the structural bridge, the other bats with structural bridges were no longer studied. The next bat that was analyzed using the model time history was a bat with a shell thickness of 0.05 inches. A plot for relative displacement versus time for this bat can be seen in FIG. 12.

When the wall thickness is reduced, the bat becomes more flexible and easier to bend. It is readily seen, when comparing FIG. 9 and FIG. 12 that the 0.05-inch thick walled bat's displacement is larger in amplitude than that of the bat with a wall thickness of 0.1 inches. The displacement is larger in the thinner shelled bat because it will bend easier.

Figure 13:
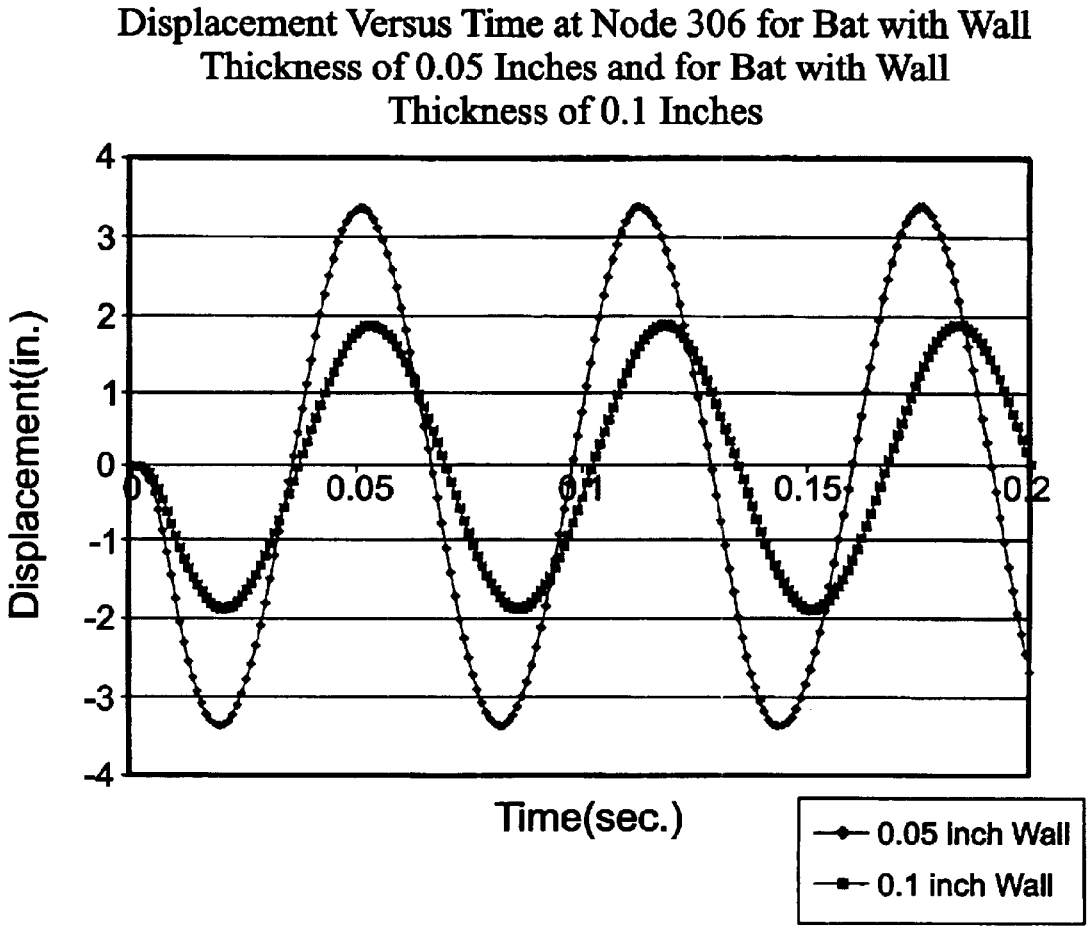
FIG. 13 shows a comparison of displacement versus time curves for a bats with wall thickness of 0.05 inches and of 0.1 inches.

FIG. 13 is a plot of the displacement versus time at node 306 for a bat with a wall thickness of 0.05 inches and a bat with a wall thickness of 0.1 inches. Besides having lower displacement amplitude, the thicker shelled bat's period shifts more to the right than the thinner shelled bat.

Experiment

An experiment that measured sound amplitude and bat vibration was also performed on the base model bat and the bat with a structural bridge centered at a distance 48 which was 31.54% from the barrel end 22. The bat's sound amplitude was measured because the vibration of a bat is directly proportional to the sound amplitude.

Figure 14:
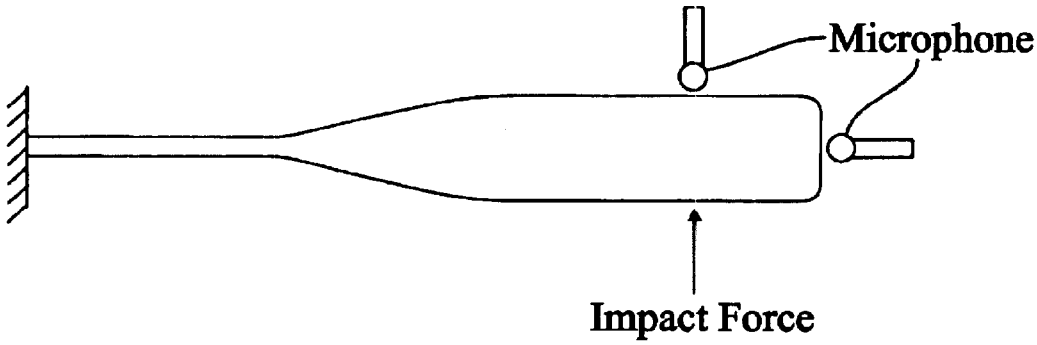
FIG. 14 is a schematic illustration of an experimental setup for measuring the sound amplitude of a bat after impact.

For the experiment, the handle of a bat was clamped. A microphone was placed near the middle section of the barrel and one was placed at the tip of the barrel. The bat was then impacted in the middle of the barrel region. The microphones were then used to measure the sound amplitude of the bat. FIG. 14 is a drawing of the experiment setup.

Figure 15:
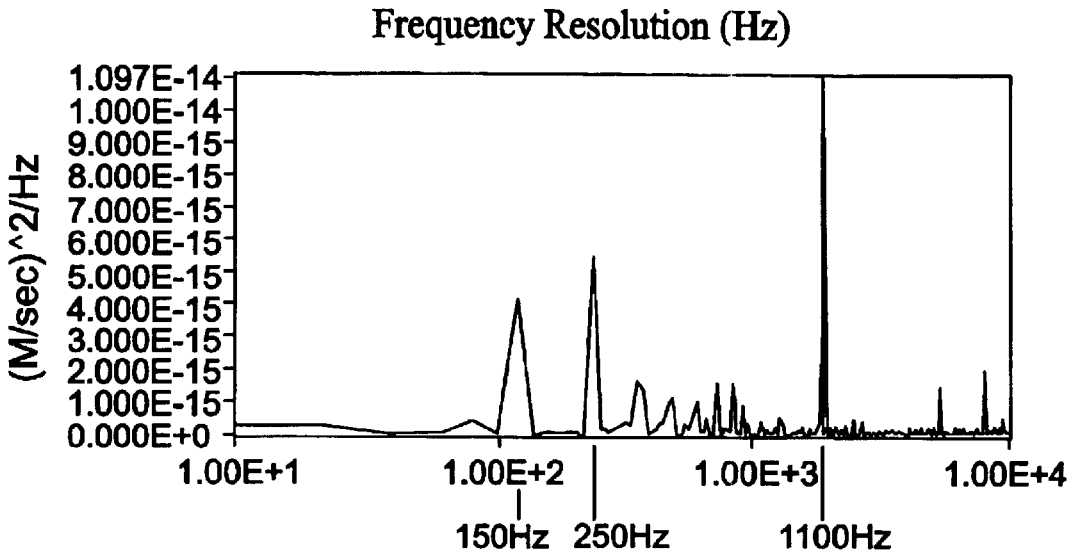
FIG. 15 is a graphical display of the Fourier transform information showing the sound amplitudes determined with the test structure of FIG. 20 for a bat without a structural bridge.
Figure 16:
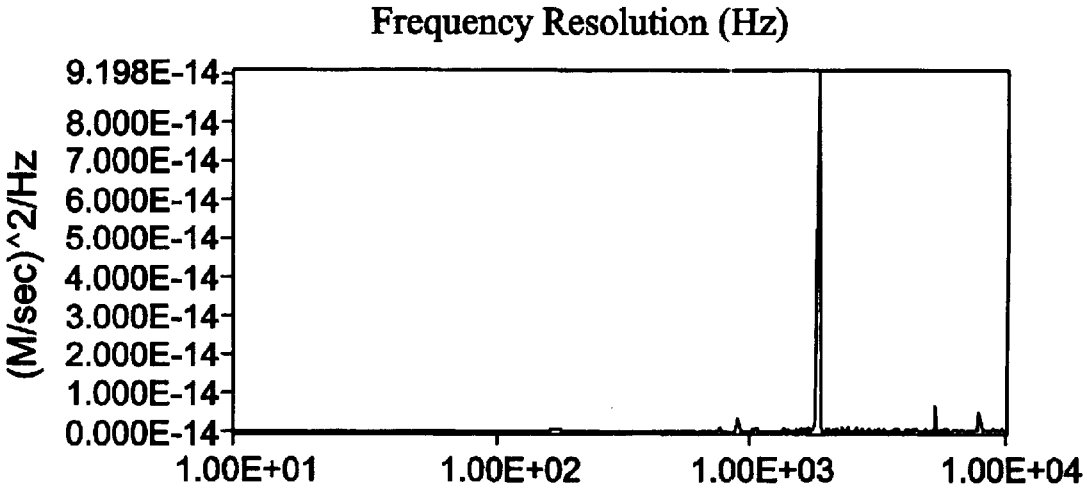
FIG. 16 is a graphical display similar to FIG. 21 for a bat with a structural bridge centered at 31.54% of the distance from the barrel end.

Energy versus frequency plots of the Fourier transforms of the microphone signals can be seen in FIGS. 15 and 16. FIG. 15 is the Fourier transform of the microphone signal of the base model bat and FIG. 16 represents the bat with a structural bridge centered at 31.54%.

According to the Fourier transform of the microphone signals, the bat with a structural bridge centered at 31.54% has a single specific frequency of vibration. It can be seen in FIG. 15 that the base model bat does not have a single frequency of vibration but many frequencies. When the energy is spread out over many frequencies, a lot of energy is being lost. However, when there is a single specific frequency peak, most of the energy is concentrated at and around this specific frequency. More energy is present at the specific frequency than the energy that is distributed through the many frequencies. If energy is integrated for the many frequencies of the base model bat and for the specific frequency of the bat with the structural bridge centered at 31.54%, the sum of the distributed integrated energy from the base model bat will be similar to the integrated energy at the specific frequency of the bat containing the structural bridge.

As seen in FIG. 15, there are three substantial peaks of energy, which are located at approximately 150 Hz, 250 Hz and 1100 Hz. Those three peaks represent the energy of the first, second and third modes of vibration of the bat.

As seen in FIG. 16, when the structural bridge 28 is added at the preferred location on the bat 10, the first two peaks corresponding to the first and second modes of vibration disappear, as do most of the other minor peaks, but the third peak remains. Thus, energy from the impact between the bat and ball which was previously transformed into first and second modes of vibration of the bat, is now transformed into the third mode of vibration, thus increasing the third mode of vibration which as previously noted, is the mode which is most responsible for effective energy transfer from the bat to the ball.

Alternative Embodiment Utilizing Thin-Walled Rings

Figure 17:
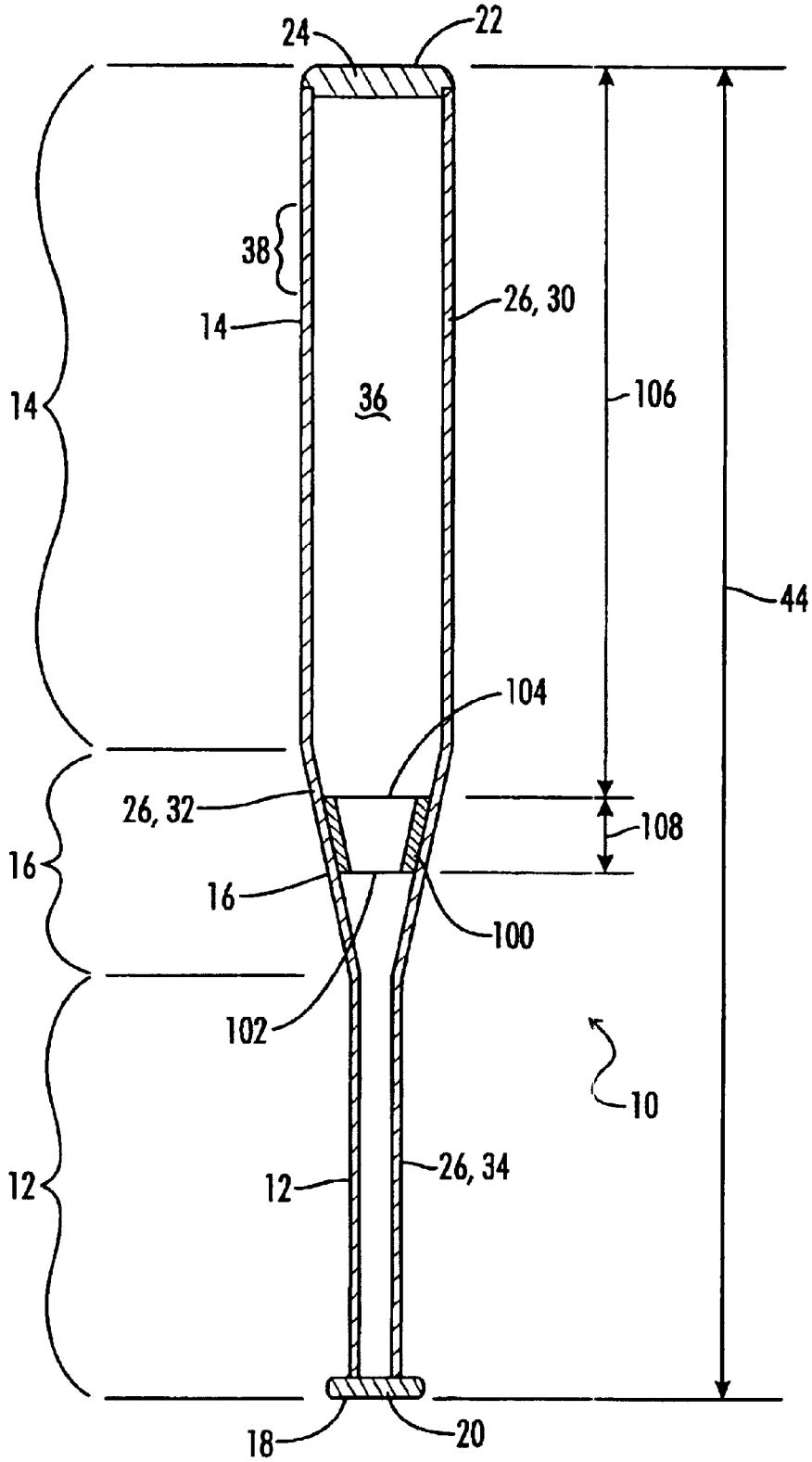
FIG. 17 is a cross-sectional view of an alternative embodiment of the bat of the present invention having a thin-walled frusto-conical shaped reinforcing ring located inside the transition portion of the bat.

Referring now to FIG. 17, an alternative embodiment of the invention is shown wherein the disc-shaped structural bridge or ring 28 has been replaced with a conical-shaped thin-walled structural bridge or ring designated by the numeral 100. Ring 100 may also be referred to as a thin tubular ring. In this embodiment, the ring is located in the transition portion 16 and is attached to the circumferential wall portion 32 thereof.

The metal reinforcing ring 100 can be described as a frusto-conical shaped ring, that is a conical-shaped ring having its smaller diameter end 102 cut off. The frusto-conical shaped ring 100 is shaped complimentarily to the shape and dimensions of the transition portion 16 so that the ring 100 nests within the transition portion 16. For example, in one embodiment of the invention, the distal end 104 of ring 100 is located a distance 106 from the distal end 22 of the bat 10, which distance 106 may be 15.5 inches. The ring 100 has a length 108 equal to 2.0 inches. The ring 100 has a wall thickness of 0.075 inches. The ring 100 has an outer diameter at its distal end 104 equal to 1.520 inches, and an outer diameter at its proximal end 102 equal to 1.230 inches.

The thin-walled conical ring 100 may be attached to the bat 10 either by an adhesive or by welding, as previously described with regard to the bat of FIG. 1.

It will be understood that a cylindrical thin-wall ring of similar dimensions to the ring 100, having a straight wall rather than a conical-shaped wall, could be placed within the barrel portion 14 of the bat 10.

Figure 18:
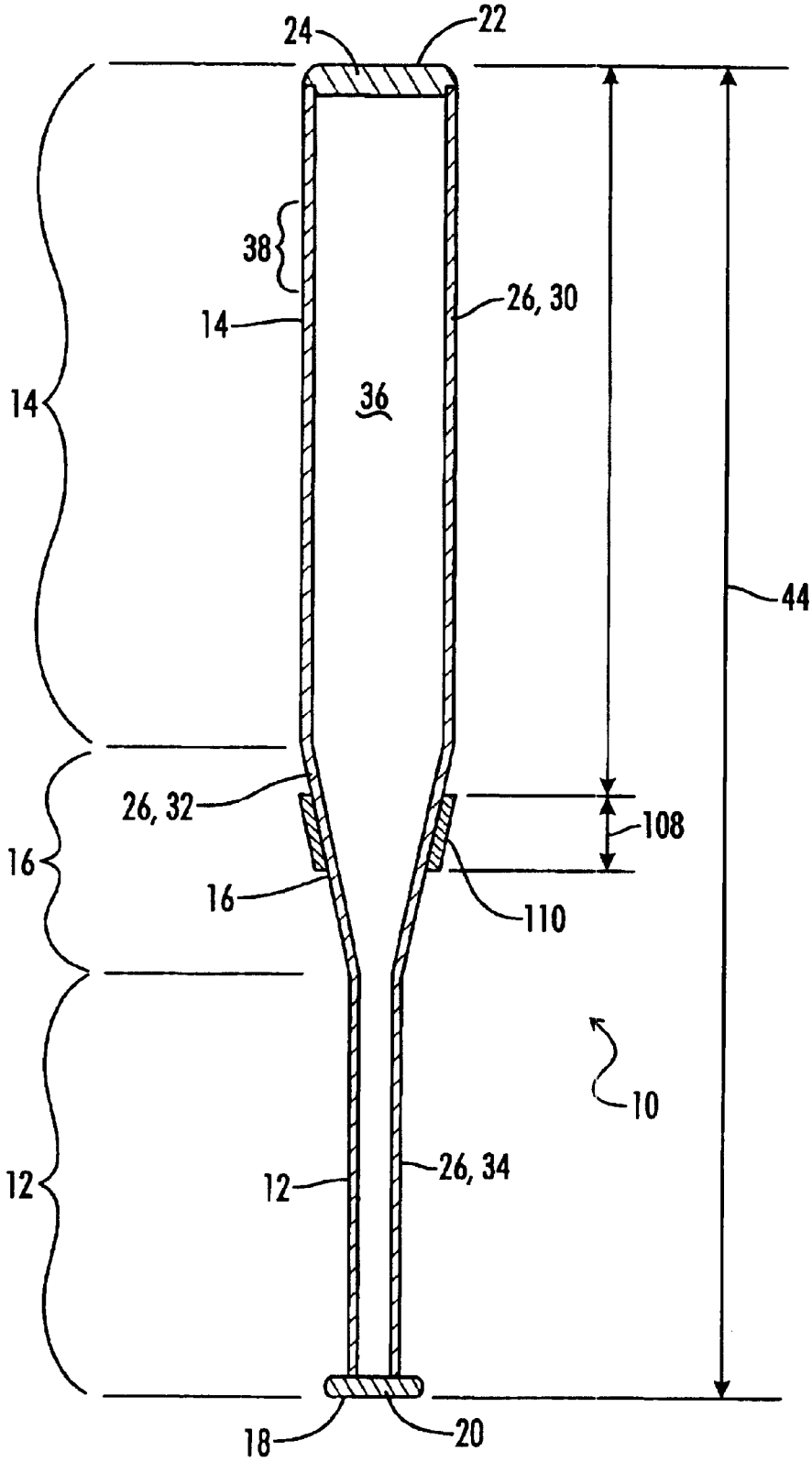
FIG. 18 is a cross-sectional view of an alternative embodiment of the bat of the present invention having a thin-walled frusto-conical shaped reinforcing ring located outside the transition portion of the bat.

Turning now to FIG. 18, still another embodiment of the invention is shown having a thin-wall frusto-conical-shaped reinforcing ring, which this time, is located on the outside of the transition portion 16 of the bat 10.

This externally located frusto-conical-shaped reinforcing ring is designated by the numeral 110. It too may be connected to the transition portion 16 either by adhesive or by welding or by press fitting. It too has a shape and a dimension complementary to that of the transition portion 16. The external reinforcing ring 110 is constructed so that the transition portion 16 nests within the external reinforcing ring, which may be example have a length 108 of 2.0 inches, and a wall thickness of 0.075 inches. The ring 110 could also be placed about the bat before completion of the swaging operation which forms the tapered portion, and then the tapered portion and ring 110 can be swaged together to hold ring 110 in place.

The thin tubular ring has a length 108 much greater than the wall thickness of the ring. For example, the length 108 might be described as being at least ten times greater than the wall thickness, and preferably at least 100 times greater than the wall thickness of the ring.

Figure 22:
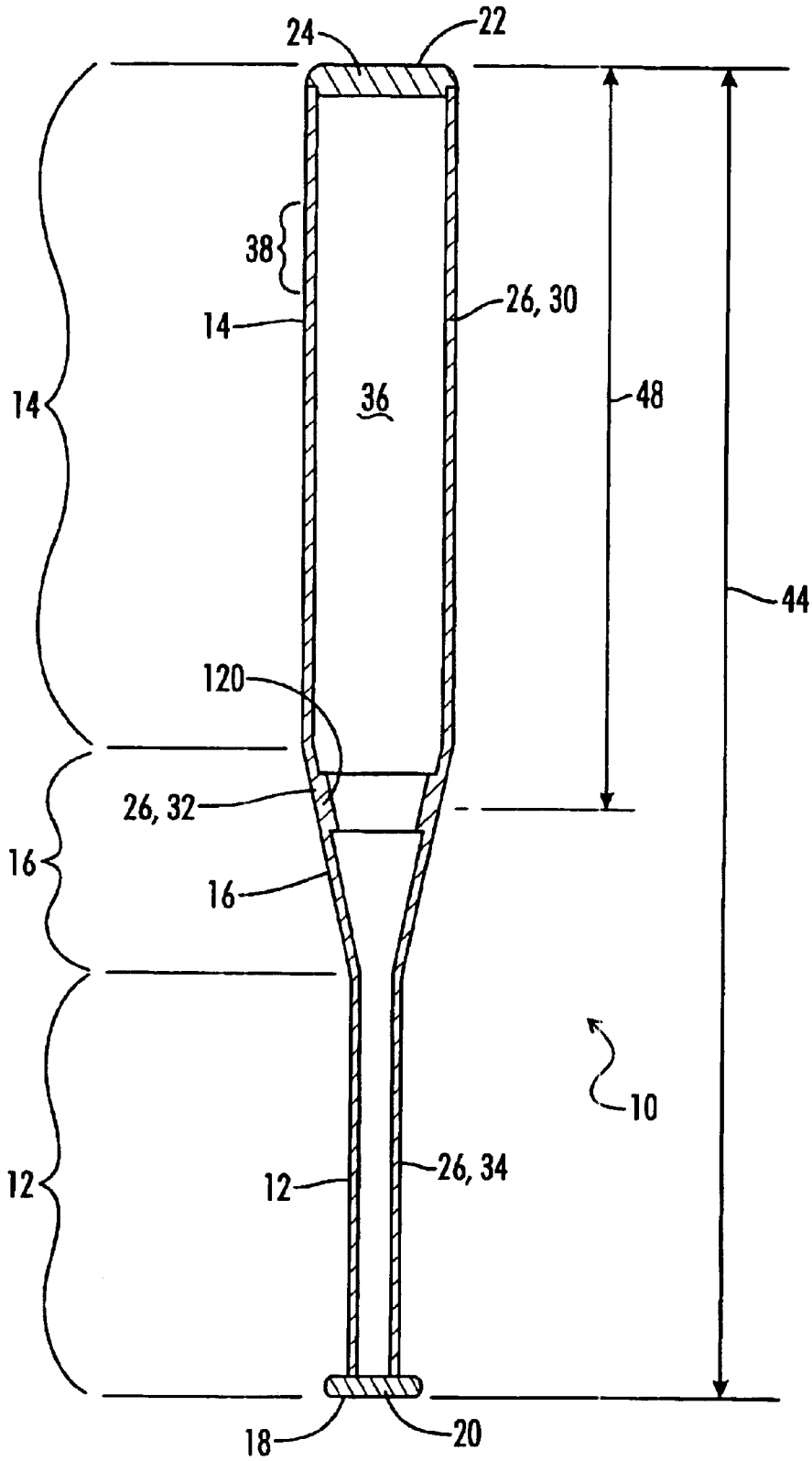
FIG. 22 is a view similar to FIG. 1, showing a bat with an integrally formed structural bridge located within the transition portion of the bat.

Although the various examples shown use only a single reinforcing ring or disk, multiple rings or disks could be used to fine tune the vibrational response of the bat. cl Alternative Embodiment With Integral Structural Bridge FIG. 22 shows a bat 10 having an integrally formed structural bridge 120 located within the transition portion 16. Such a bat can be formed by starting with a metal tubular cylinder having an internal annular ledge, and then swaging the cylinder into the shape of the bat, with the integral annular ledge forming the structural bridge 120. The dimensions of the integral structural bridge 120 would be similar to those of the internal ring 100 of FIG. 17.

Thus, it is seen that the apparatus of the present invention readily achieves the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. A tuned sports implement, comprising:

an impact portion constructed to impact a ball;

a handle portion constructed to be held by a human hand;

a tubular structural member including an outer wall defining an interior space, the structural member connecting the impact portion and the handle portion; and a structural bridge received in the interior space of the structural member and attached to the outer wall, the structural characteristics of the bridge being selected to increase energy transfer between the implement and the ball;

wherein the handle portion is tubular and is an integral portion of the structural member;

wherein the impact portion is tubular and is an integral portion of the structural member;

wherein the implement is a bat; and wherein the structural characteristics of the bridge are selected to reduce mode 1 and 2 vibration of the bat and increase mode 3 vibration of the bat.

2. The bat of claim 1, wherein the bat is constructed of aluminum.

3. The bat of claim 2, wherein the structural bridge is a ring.

4. The bat of claim 3, wherein the ring is attached to the wall with an adhesive.

5. The bat of claim 4, wherein the adhesive provides a means for dampening vibration of the implement upon striking a ball.

6. The bat of claim 3, wherein the ring is welded to the wall.

7. The bat of claim 1, wherein the structural characteristics include at least one characteristic selected from the group consisting of the dimensions, material, mass and location of the bridge.

8. The bat of claim 7, wherein the material of the bridge is aluminum.

9. The bat of claim 1, wherein the structural characteristics of the bridge are chosen to tune the bat's third mode of vibration to a selected range.

10. The bat of claim 9, wherein the selected range is from 1100 to 1300 cycles/second.

11. The bat of claim 1, wherein the structural characteristics of the bridge are selected to provide a resonance interaction between the bat and the ball.

12. The bat of claim 1, wherein the structural characteristics of the bridge are selected to increase the size of a sweet spot of the bat.

13. The implement of claim 1, wherein the structural bridge is a ring.

14. The implement of claim 13, wherein the ring is a thin tubular ring.

15. The implement of claim 14, wherein:

the tubular structural member includes a tapered transition portion; and the thin tubular ring is frusto-conical shaped and is received in the tapered transition portion of the bat.

16. The implement of claim 1, wherein the structural member is constructed of metal.

17. The implement of claim 16, wherein the structural bridge is welded to the wall.

18. The implement of claim 1, wherein the structural bridge is attached to the wall with an adhesive.

19. The implement of claim 18, wherein the adhesive provides a means for dampening vibration of the implement upon striking a ball.

20. A tubular metal ball bat, comprising:

a handle portion;

a barrel portion;

a transition portion joining the handle portion and the barrel portion, both the barrel portion and the transition portion having a circumferential wall;

a structural bridge located within at least one of the barrel portion and the transition portion and attached to the circumferential wall; and wherein the structural characteristics of the bridge are chosen to tune the bat's third mode of vibration to a range from 1100 to 1300 cycles/second.

21. The bat of claim 20, wherein the structural bridge is a ring having a central opening defined therethrough.

22. The bat of claim 21, wherein the ring is a thin tubular ring.

23. The bat of claim 22, wherein the thin tubular ring has a length much greater than a wall thickness of the ring.

24. The bat of claim 22, wherein the length of the ring is at least ten times the wall thickness of the ring.

25. The bat of claim 22, wherein the length of the ring is at least one hundred times the wall thickness of the ring.

26. The bat of claim 21, wherein:

the ring is frusto-conical in shape; and the ring is received in the transition portion of the bat.

27. The bat of claim 20, wherein the structural bridge is constructed of aluminum.

28. The bat of claim 27, wherein the structural bridge is welded to the outer wall of the barrel portion.

29. The bat of claim 20, wherein the structural bridge is attached to the wall with an adhesive.

30. The bat of claim 29, wherein the adhesive provides a means for dampening vibration of the bat upon striking a ball.

31. The bat of claim 20, wherein the structural characteristics include at least one characteristic selected from the group consisting of the dimensions, material, mass and location of the bridge.

32. The bat of claim 20, wherein the structural characteristics of the bridge are selected to provide a resonance interaction between the bat and the ball.

33. The bat of claim 20, wherein the structural characteristics of the bridge are selected to increase the size of a sweet spot of the bat.

34. The bat of claim 20, wherein the structural characteristics of the bridge are selected to reduce mode 1 and 2 vibration of the bat and increase mode 3 vibration of the bat.

35. The bat of claim 20, wherein the structural bridge is located adjacent a junction between the barrel portion and the transition portion of the bat.

36. A tubular metal ball bat, comprising:

a handle portion;

a barrel portion;

a tapered transition portion joining the handle portion and the barrel portion, the transition portion having a circumferential wall; and a metal reinforcing ring located entirely in the tapered transition portion and attached to the circumferential wall of the transition portion.

37. The bat of claim 36, wherein:

the metal reinforcing ring is a frusto-conical ring shaped complementary to the tapered transition portion so that one of the ring and the transition portion nests within the other of the ring and the transition portion.

38. The bat of claim 37, wherein the ring is located inside the transition portion and the ring nests within the transition portion.

39. A tuned sports implement, comprising:

an impact portion constructed to impact a ball;

a handle portion constructed to be held by a human hand;

a tubular structural member including an outer wall defining an interior space, the structural member connecting the impact portion and the handle portion;

a structural bridge received in the interior space of the structural member and attached to the outer wall, the structural characteristics of the bridge being selected to increase energy transfer between the implement and the ball; and wherein the structural characteristics of the bridge are chosen to tune the implement's third mode of vibration to a range of from 1100 to 1300 cycles/second.

40. A tuned sports implement, comprising:

an impact portion constructed to impact a ball;

a handle portion constructed to be held by a human hand;

a tubular structural member including an outer wall defining an interior space, the structural member connecting the impact portion and the handle portion;

a structural bridge received in the interior space of the structural member and attached to the outer wall, the structural characteristics of the bridge being selected to increase energy transfer between the implement and the ball; and wherein the structural characteristics of the bridge are selected to reduce mode 1 and 2 vibration of the bat and increase mode 3 vibration of the implement.

* * * * *

UNITED STATES PATENT AND TRADEMARK OFFICE

CERTIFICATE OF CORRECTION

PATENT NO. : 6,729,983 B1
DATED : May 4, 2004
INVENTOR(S) : Vakili et al.

It is certified that error appears in the above-identified patent and that said Letters Patent is hereby corrected as shown below:

Column 1,
Line 26, replace “Bujatti” with -- Buiatti --;
Line 32, replace “use,of” with -- use of --.

Column 7,
Line 55, insert -- in -- after “Displacements”.

Column 8,
Line 44, insert -- optimum -- before “location”.

Column 9,
Line 38, repalce “activity’ with -- conductivity --.

Column 10,
Line 45, replace “1.59” with -- 1.89 --.

Column 13,
Line 60, delete “cl” after “bat.”.

Column 14,
Line 25, delete “portion” after “handle”.

Signed and Sealed this

Third Day of August, 2004

JON W. DUDAS
*Acting Director of the United States Patent and Trademark Office*